United States Patent [19]

Dummermuth

[11] Patent Number: 4,630,687

[45] Date of Patent: Dec. 23, 1986

[54] PERCUSSION DEVICE

[75] Inventor: Paul Dummermuth, Zunzgen, Switzerland

[73] Assignee: Von Arx AG, Sissach, Switzerland

[21] Appl. No.: 667,281

[22] Filed: Nov. 1, 1984

[30] Foreign Application Priority Data

Nov. 4, 1983 [CH] Switzerland ..... 5962/83

[51] Int. Cl.[4] ..... B25D 9/00

[52] U.S. Cl. ..... 173/131; 173/128; 173/51; 29/81 D

[58] Field of Search ..... 173/128, 131, 126, 50, 173/51, 101; 29/81 D

[56] References Cited

U.S. PATENT DOCUMENTS 3,344,868 10/1967 Mikiya et al. ..... 173/51

3,618,678 6/1970 Smith ..... 173/131

3,680,643 8/1972 Cameron et al. ..... 173/51

*Primary Examiner*—Donald R. Schran

*Assistant Examiner*—James L. Wolfe

*Attorney, Agent, or Firm*—Karl F. Ross; Herbert Dubno

[57] ABSTRACT

A pneumatic hammer comprises a cylindrical housing, in which are a free piston, an anvil, and needles the rear ends of which end in heads designed to rest against the anvil and supported by a tool holder. The anvil comprises a steel cylinder in the lateral surface of which is an annular rebate. The cylinder is surrounded by a plastics material in the rebate, the outer surface of which material forms the cylindrical sliding surface of the anvil. The volume occupied by the plastics material is approximately 50% of the total volume, such that the mass of the anvil is approximately halved.

3 Claims, 1 Drawing Figure

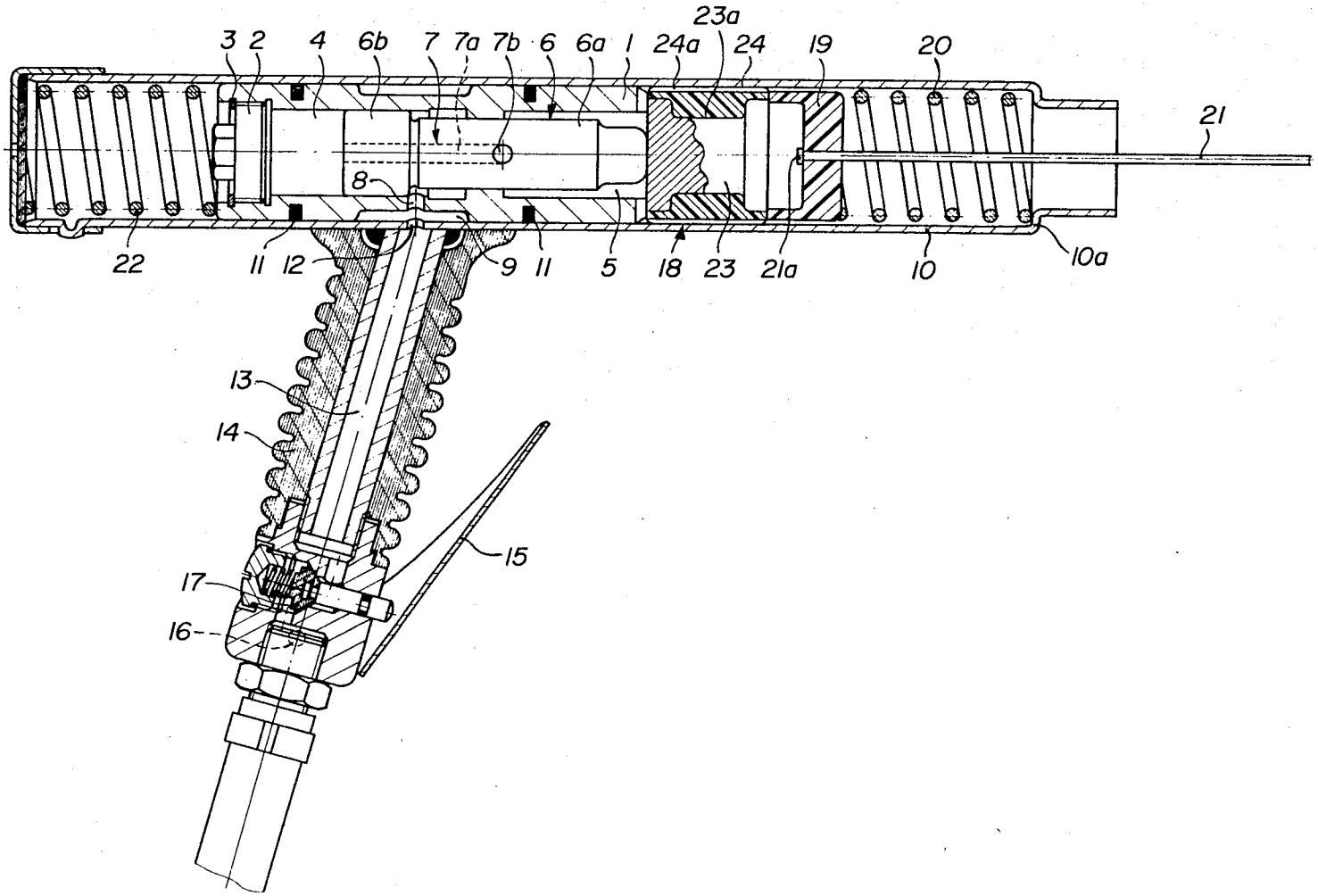
21
10a
20
10
19
21a
24
23a
23
24a
18
1
5
6a
6
11
7b
9
7a
7
6b
8
4
12
11
3
2
13
14
15
17
16
22

PERCUSSION DEVICE

The present invention relates to a percussion device comprising an elongate housing, at the front end of which at least one elongate tool projects axially, a tool holder mounted to slide longitudinally inside the housing, a spring for pressing the tool holder against an anvil, a cylinder the front end of which acts as a rear abutment for the anvil and which is open to permit a free piston mounted inside to pass axially along it, the piston acting as a percussion member, and drive means to start up and maintain a series of percussions of the said member against the said anvil at a given frequency.

Known devices of this type are used, in particular, with a bundle of needles for cleaning surfaces, or with a chisel. It has been noted for some time that the regularity of strike of the free piston against the anvil is improved as the mass of the anvil is decreased. Since the anvil slides inside the elongate housing, it is necessary that the axial dimension of the anvil is sufficient to ensure guidance. Furthermore, since the anvil slides back and forth, its cylindrical surface is subjected to case-hardening in order to strengthen it. It has been proposed to carry out diametrical drilling in order to reduce the weight of the anvil without decreasing its length, in order to preserve the same guiding surface. Drilling of this type requires an additional operation and increases the price of the anvil. Furthermore, it only brings about a small decrease in mass of approximately 25%. Even with conventional anvils it has been observed that wear results gradually from the anvil sliding inside the housing, which appears in the form of a swelling of the housing around the anvil. This swelling causes the diameter of the housing to increase and increases the clearance between it and the anvil, and causes the anvil to slant and finally to ruin the housing completely, making it useless.

The aim of the invention is to provide a percussion device which avoids, at least in part, the two disadvantages mentioned above.

To this end, the invention provides a percussion device comprising an elongate housing from the front end of which a rod-shaped tool projects axially, a tool holder mounted to slide longitudinally inside the housing, a spring to elastically press the tool holder against a cylindrical anvil, a cylinder the front end of which acts a rear abutment for the anvil and which is open to allow the axial passage of a free piston which is mounted to the cylinder and acts as a percussion device, and the drive means to start up and maintain a series of percussions of the said percussion device at a given frequency against the said anvil, characterized in that the cylindrical face of the anvil comprises a plastics material surrounding a metal cylinder, between the axial end faces of which cylinder is an annular recess filled with the said plastics material, the total volume thus occupied by this plastics material representing approximately 50% of the total volume of the anvil.

This solution has the advantage of making the anvil considerably lighter without reducing either its shock resistance or its length and thus its guiding surface in the housing, and of replacing the metal guiding surface with a plastics material which can be selected from self-lubricating plastics materials. In view of the fact that the cylindrical surface of the metal cylinder no longer has to be hardened, the proposed solution does not increase the price of the device, quite the contrary, as the moulding of the plastics material is substituted for the operations of drilling and hardening. The decrease in the weight of the anvil is, moreover, approximately double that obtained by diametrical drilling.

BRIEF DESCRIPTION OF THE DRAWING

The single FIGURE of the accompanying drawings illustrates diagrammatically in cross-section, by way of example, an embodiment of the percussion device which is the subject of the invention.

SPECIFIC DESCRIPTION

The drawing shows a pneumatic hammer which comprises a cylinder 1, the front end of which is open and the rear end of which is closed by a plug 2 held in place by a spring ring 3. This cylinder 1 forms two compartments 4 and 5. A free piston 6 having a front section **6*a* of small diameter and section rear 6*b* of large diameter is mounted to slide inside the cylinder 1. It is formed with a T-shaped passage 7 having an axial part which extends from the rear end 6*b* of the free piston 6 to a diametrical part 7*b*. An aperture 8 connects the compartment 4 of the cylinder 1 to an annular space 9 between the cylinder 1 and a housing 10 in which the cylinder 1 is mounted to slide axially. The annular space 9 is sealed by two seal rings 11 disposed in the cylinder 1 at opposite ends of this annular space 9. A further aperture 12 in the wall of the housing 10 services to connect the annular space 9 to a supply duct 13 passing longitudinally through a pistol grip 14 fixed laterally to the housing 10. The supply duct 13 is designed to be connected to a compressed air supply (not shown). A lever 15 articulated about a transverse axis 16 on the handle 14 controls opening and closing of a valve 17 controlling the supply duct 13. The open front end of the cylinder 1 is in contact with an anvil 8 against the face of which a tool holder 9 is pressed by a spring 20 which rests against a reduced-diameter part 10*a* of the housing 10. A bundle of needles 21 (only one shown) for cleaning purposes is supported by the tool holder. The needles 21 extend slidably through the tool holder 19 and have heads 21*a* arranged to make contact with the front face of the anvil 18** when the tool is placed against a surface to be worked.

The anvil 18 comprises a steel cylinder 23, between the end faces of which is an annular outwardly open groove **23*a*. The steel cylinder 23 is surrounded by a plastic, preferably polyamide, sleeve the outer surface of which forms the cylindrical sliding surface 24 and which has longitudinal grooves 24*a* distributed around the circumference to permit air to escape from the compartment 4 when the latter is connected to compartment 5 by the T-shaped passage 7. The volume of polyamide forming the sliding surface 24 and filling the annular groove 23*a*, including that of the longitudinal grooves 24*a*, is approximately 50% of the total volume of the anvil. Taking into account the corresponding relative densities of the steel and polyamide, the reduction in the weight of the anvil is also approximately 50%, for a given length of sliding surface 24. Furthermore, the fact that the sliding surface is made of polyamide improves the sliding of the anvil and reduces the risk of damage to the housing. Long term tests did not reveal any deterioration of the housing 10**. During these tests a higher strike regularity was achieved which revealed itself as a virtual elimination of strike misses.

The rear end of the cylinder 1 is acted on by a spring 22 compressed between the said cylinder and the rear end of the housing 10.

When the device is used, the front ends of the needles 21 are placed against the surface to be worked, so that their heads 21*a* come into contact with the front end of the anvil 18. The spring is compressed to a lesser or greater degree, depending on the pressure exerted. When the valve 17 controlling the supply duct is opened by depressing the lever 15 against handle 14, the compressed air is let into the compartment 4 of the cylinder 1. Because of the T-shaped channel 7, the air is fed between the rear face of the free piston 6 and the rear end of the compartment 4, the base of which comprises the plug 2. The free piston 6 then moves forwards in the direction of the anvil 18, against the rear face of which the piston strikes. In this position the rear part of the compartment 4 is no longer in communication with the supply of compressed air, but with compartment 5 which is open at the front, so that the compressed air in the rear part of the compartment 4 escapes. As the front part of the same compartment 4, comprising an annular space disposed around the front section of small diameter 6*a* of the free piston 6, remains in communication with the compressed air supply, the pressure is increased in this annular space and moves the piston 6 backwards, after which the cycle begins again.

Comparative long term tests have been carried out, on the one hand using a conventional device fitted with an anvil made entirely of steel, mounted in a housing the wall of which has been casehardened and lubricated with a graphite lubricant, and on the other hand using a device fitted with an anvil according to the invention, mounted in a non-hardened housing.

In the conventional device, after 100 hours use, a swelling of the housing around the anvil can be observed, which makes the housing unusable. In the case of the device according to the invention, after 1200 hours use there is not the slightest trace of deterioration in the housing, and the anvil does not display any visible wear. The reduction in weight does not adversely affect its useful life.

Diagrams drawn with the aid of accelerometers placed on the device register greater regularity in the case of the lighter anvil according to the invention.

It can thus be seen that the weight reduction of the anvil by insert moulding with plastics material, a simple measure, results in a spectacular improvement in the useful life of the device housing, whilst eliminating the necessity of having to harden the housing. Consequently, although the anvil requires an additional operation of moulding polyamide 6, the manufacture of the non-hardened housing is simplified so that the observed improvement hardly increases the production costs.

This invention is of course not confined to the described embodiment, but can be applied to any type of percussion tool comprising an anvil and at least one tool designed to be applied to the front face of the anvil, the rear face of which is struck by a free piston. In this way, as is known, the bundle of needles may be replaced a chisel.

I claim:

1. A percussion device comprising an elongate housing from the front end of which a tool projects axially, a tool holder mounted to slide longitudinally inside the housing, an axially displaceable anvil in the housing having a front end forwardly axially engageable with the tool, a rear end, and a sliding surface between the ends slidably supporting the anvil in the housing;

a spring which presses the tool axially backward against the front end of the anvil;

a cylinder the front end of which is axially forwardly engageable with the rear end of the anvil and which is open;

a free piston which is axially movable in the cylinder and which acts as a percussion device axially forwardly engageable with the rear end of the anvil, and drive means to start up and maintain a series of percussions of the said percussion device against the said anvil, characterized in that the anvil comprises a high-density metal body integrally forming the front and rear ends of the anvil and at least one low-density annular body of plastics material encircling the metal body and forming the sliding surface thereof, the total volume occupied by this plastics material being a substantial portion of the total volume of the anvil.

2. A percussion device as claimed in claim 1 in which the total volume occupied by the plastics material is approximately 50% of the total volume of the anvil.

3. A device according to claim 1 characterised in that the said plastics material is a polyamide.

* * * * *